US010724761B2

(12) United States Patent
McGraw et al.

(10) Patent No.: US 10,724,761 B2
(45) Date of Patent: Jul. 28, 2020

(54) MODULAR HEAT TRANSFER UNITS

(71) Applicant: SolarXWorks, LLC, Moses Lake, WA (US)

(72) Inventors: Donald Stevens McGraw, Portland, OR (US); Blake Bradley Barthelmess, Moses Lake, WA (US); Scott Jeffrey Brown, Moses Lake, WA (US); Torsten Hartmann, Moses Lake, WA (US)

(73) Assignee: SolarXWorks, LLC, Moses Lake, WA (US)

( * ) Notice: Subject to any disclaimer, the term of this patent is extended or adjusted under 35 U.S.C. 154(b) by 118 days.

(21) Appl. No.: 16/007,952

(22) Filed: Jun. 13, 2018

(65) Prior Publication Data

US 2019/0383515 A1 Dec. 19, 2019

(51) Int. Cl.

| | |
|---|---|
| ***F24F 1/02*** | (2019.01) |
| ***F24F 13/20*** | (2006.01) |
| ***F24F 1/022*** | (2019.01) |
| ***F24F 1/0003*** | (2019.01) |
| *F24F 1/12* | (2011.01) |
| *F24F 1/0059* | (2019.01) |
| *F24F 13/02* | (2006.01) |
| *F24F 1/027* | (2019.01) |
| *F24F 1/40* | (2011.01) |
| *F24F 1/0033* | (2019.01) |

(52) U.S. Cl.

CPC ..... *F24F 13/20* (2013.01); *F24F 1/0003* (2013.01); *F24F 1/022* (2013.01); *F24F 1/0033* (2013.01); *F24F 1/0059* (2013.01); *F24F 1/02* (2013.01); *F24F 1/027* (2013.01); *F24F 1/12* (2013.01); *F24F 1/40* (2013.01); *F24F 13/0236* (2013.01); *F24F 2221/36* (2013.01)

(58) Field of Classification Search

CPC ..... F24F 13/20; F24F 1/0003; F24F 1/022; F24F 2221/36; F24F 1/0033; F24F 1/0059; F24F 1/02; F24F 13/0236; F24F 1/027; F24F 1/12; F24F 1/40

See application file for complete search history.

(56) References Cited

U.S. PATENT DOCUMENTS

| | | | | |
|---|---|---|---|---|
| 2,708,833 A * | 5/1955 | Nigro | F24F 1/34 | 62/262 |
| 2,708,835 A * | 5/1955 | Nigro | F24F 1/0003 | 62/262 |
| 3,012,762 A | 12/1961 | Norris | | |
| 3,018,642 A * | 1/1962 | Lathrop | F24F 1/02 | 62/427 |
| 3,602,006 A * | 8/1971 | Metcalfe | F24F 1/02 | 62/262 |
| 4,129,013 A | 12/1978 | Hine, Jr. | | |
| 6,199,396 B1 * | 3/2001 | Aizawa | F16K 1/10 | 137/360 |
| 6,354,521 B1 * | 3/2002 | Kusilek | F16L 37/138 | 239/600 |

(Continued)

*Primary Examiner* — Frantz F Jules
*Assistant Examiner* — Lionel Nouketcha
(74) *Attorney, Agent, or Firm* — Lee & Hayes, P.C.

(57) ABSTRACT

A heat transfer unit includes housing that includes a compressor, a condenser, one or more fans, and an air duct disposed on a side of the compressor unit. The heat transfer unit is configured such that the unit may operate in a mini-split or stacked configuration.

20 Claims, 6 Drawing Sheets

(56) References Cited

U.S. PATENT DOCUMENTS

| | | | | |
|---|---|---|---|---|
| 7,862,410 | B2 | 1/2011 | McMahan et al. | |
| 2005/0263148 | A1 | 12/2005 | Rand | |
| 2015/0075766 | A1 | 3/2015 | Alston | |
| 2016/0245570 | A1* | 8/2016 | Han | F25B 49/022 |
| 2017/0089628 | A1* | 3/2017 | Jang | F24F 1/0011 |
| 2018/0080668 | A1* | 3/2018 | Booten | F16L 5/10 |

* cited by examiner

MODULAR HEAT TRANSFER UNITS

CROSS REFERENCE TO RELATED PATENT APPLICATIONS

This application incorporates U.S. patent application Ser. No. 15/786,444, filed on Oct. 17, 2017, entitled "DC Refrigeration System Controls," in its entirety by reference.

BACKGROUND

Thermal climate control is a technology that provides immense capabilities and benefits to the developed world. One example may be advancements in refrigeration or air conditioning. Refrigeration allows items that, under normal environmental conditions, would perish after a particular amount of time common to the item, to be preserved for longer periods of time than is common. For example, the expected useful life for items such as food, pharmaceutical drugs, etc., may be extended from refrigeration. With advancements in technology, refrigeration can now be placed or used in diverse locations or applications. One such application may include the use of reefer units on commercial trucks. These reefer units allow the trailer of a semi-truck to remain at a predetermined temperature for the entire duration of the truck's travel.

However, even in the developed world, refrigeration comes at great cost. The cost associated with the energy required to power refrigeration is often very high. Additionally, refrigeration units do not provide a one size fits all solution. For example, the reefer unit attached to a commercial semi-truck may not provide the best solution for storing food in a warehouse or grocery store. Therefore, these units are often tailored for a specific use to be most efficient for one specific use. This may increase the cost of individual units that need to be form fitted for a specific application. Furthermore, in remote locations or in developing countries, a perfectly tailored solution may not be readily attainable. In remote locations and in developing countries, it can be difficult to bring refrigeration units into these regions. Further, once the refrigeration unit is on site, the unit typically is used in a single application.

Thus, a solution is desired for a single heat transfer system/unit (i.e., heating, ventilation, and air conditioning (HVAC) unit, refrigeration unit, etc.) to be implemented in a variety of different applications. Additionally, it is desired that such a solution would allow users to easily configure the unit between different operating modes to accommodate the specific need.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the components on a larger scale or differently shaped for the sake of clarity.

DETAILED DESCRIPTION

This disclosure is directed to a modular heat transfer unit. While the unit described herein below is referred to as a heat transfer unit, it is to be understood that the unit described may be a heating, ventilation, and air-conditioning (HVAC) unit and/or a refrigeration unit, among other possible heat transfer units/systems. More specifically, the heat transfer unit described herein may be implemented in a variety of applications and/or configurations. While this embodiment describes an heat transfer unit used in application to cool an environment, it is contemplated that the heat transfer unit described herein may be further used for heating, ventilation, climate control, refrigeration, etc. The heat transfer unit described herein may operate in multiple modes of operation. For example, the heat transfer unit may operate in a mini-split configuration, or the heat transfer unit may operate in a stacked configuration.

When operating in a mini-split configuration, the heat transfer unit may include an outdoor unit and an indoor unit. The outdoor unit may include a compressor/condenser unit and the indoor unit may include the air-handling or evaporator unit. In some mini-split embodiments, the compressor/condenser unit may not be placed in an outdoor location, but may be placed in another environment other than the environment in which the evaporator unit resides. In the mini-split configuration, the outdoor unit and indoor unit may be in fluid and electrical communication with one another. For example, the heat transfer unit may include one or more conduits. The conduits allow for the passage of refrigerant between the compressor/condenser unit and the evaporator unit. The heat transfer unit may further include a conduit for electrical communication between the two units, or the compressor/condenser unit and the evaporator unit may be in wireless communication with each other.

A stacked configuration as described herein may include a configuration in which the mini-split capable evaporator unit is placed on top of the compressor/condenser unit and the two units may operate in conjunction as an adjoined unit. The evaporator unit and the compressor/condenser unit may include ducting that allows air flow through each of the units in such a way that the units operate in conjunction as an adjoined heat transfer unit. In an embodiment, the evaporator unit and/or the compressor/condenser unit may include one or more movable panels, the removal of which may expose openings in the respective units to align with openings in the other/companion unit. A heat transfer unit according to this application is described with respect to the figures as follows.

Figure 1:
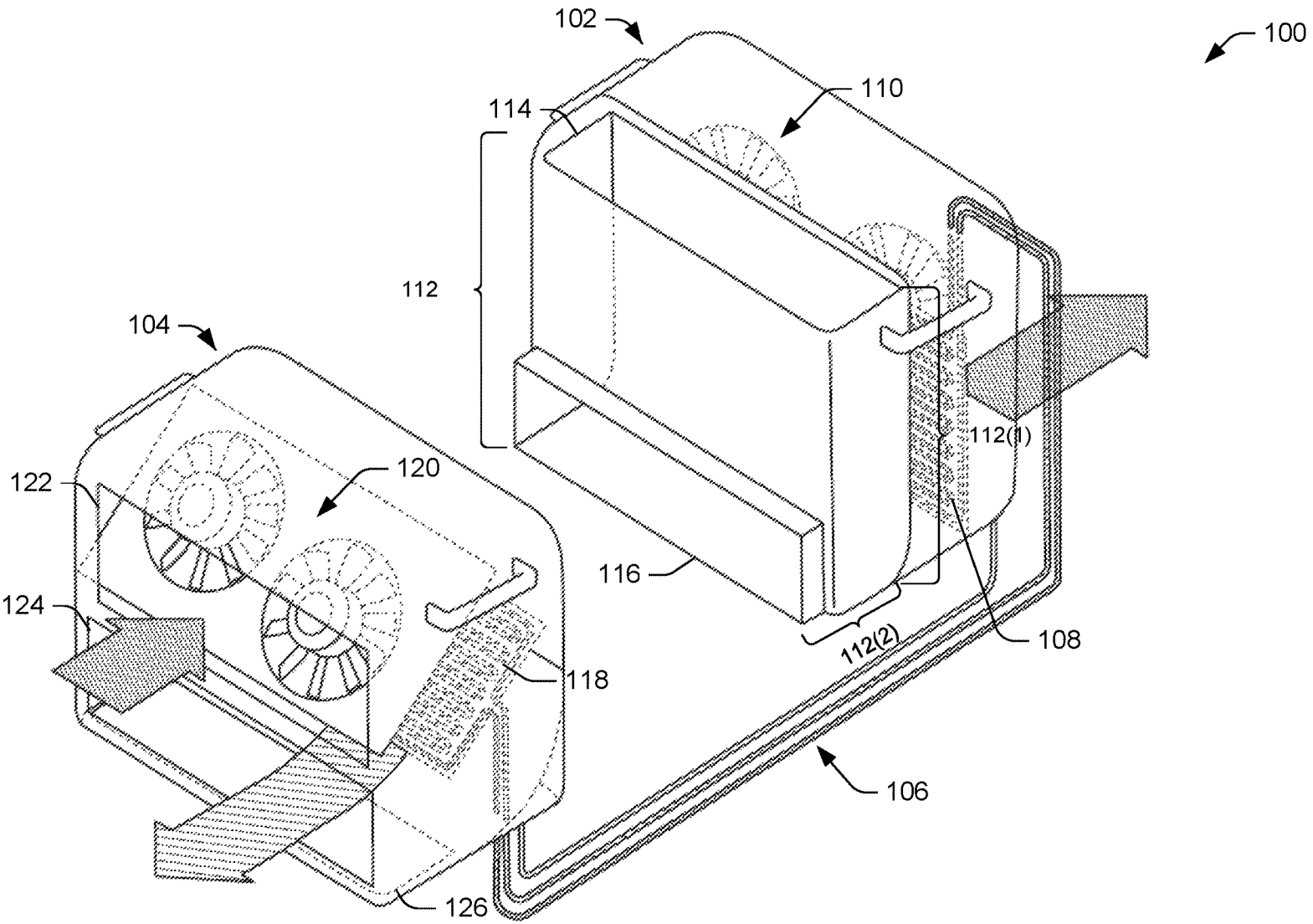
FIG. 1 illustrates a perspective view of a modular heat transfer unit in a first mode of operation.

FIG. 1 depicts a perspective view of a modular heat transfer unit (hereinafter "heat transfer unit") 100 showing internal components of the heat transfer unit. The heat transfer unit 100 is depicted in a first mode of operation. The heat transfer unit 100 may include multiple components including a compressor unit 102 and an evaporator unit 104. When operating in a first mode, as depicted in FIG. 1, the compressor unit 102 and the evaporator unit 104 may reside in different environments. For example, in the first mode of operation (i.e., mini-split configuration), the evaporator unit 104 may be placed inside the environment to be air conditioned while the compressor unit 102 may be placed outside the environment that is air conditioned. One such example may include a warehouse, wherein the evaporator unit 104 may be located within the warehouse while the compressor unit 102 may be located outside of the warehouse. In such an example, the heat transfer unit 100 may include one or more conduits 106 to communicatively couple the compressor unit 102 to the evaporator unit 104.

The one or more conduits 106 may provide fluid communication, electrical communication, etc. between the compressor unit 102 and the evaporator unit 104. The one or more conduits 106 used to flow refrigerant between the compressor unit 102 and the evaporator unit 104 may be pre-charged prior to installation to allow for a quick connection and set up of the heat transfer unit 100. In an embodiment, at least one of the one or more conduits 106 may include quick connect valves (i.e., quick interlock, positive lock connections, etc.). The quick connect valves may ensure that a user does not lose a full charge when switching between configurations. In an embodiment, at least one of the one or more conduits 106 may include flexible hosing.

The heat transfer unit 100 may further be electrically coupled to one or more power sources (not shown in FIG. 1). The one or more power sources may provide direct current (DC) or alternating current (AC) to the heat transfer unit 100. The one or more power sources may include, but are not limited to, at least one of or a combination of: photovoltaic energy, hydroelectric energy, wind energy, high voltage transmission lines, etc.

The compressor unit 102 may include one or more compressors. The one or more compressors may increase the pressure of a refrigerant flowing through the heat transfer unit 100. Such refrigerants may include, but are not limited to one of the following: fluorocarbons, chlorofluorocarbons, ammonia, sulfur dioxide, non-halogenated hydrocarbons, hydrocarbons, etc. The compressor unit 102 may also include a condenser 108 in fluid communication with the compressor. The condenser 108 may include a series of coils, through which, the refrigerant may flow. The condenser 108 may reduce the temperature of the refrigerant, thus condensing the refrigerant from a gas state to a liquid state. The compressor unit 102 may further include one or more fans 110. The one or more fans 110 may aid in reducing the temperature of the refrigerant flowing through the condenser 108 by blowing air over the coils of the condenser 108. In an embodiment, the one or more 110 fans may be disposed adjacent to the condenser 108.

The compressor unit 102 may further include an air duct 112 disposed on a side of a housing of the compressor unit. In an embodiment, the air duct 112 may be disposed on a first side of the compressor unit 102 that is opposite a second side, the second side having an opening(s) through which the one or more fans 110 may flow air. The air duct 112 may include a first opening 114 and a second opening 116. The first opening 114 may be located near a top of the housing of the compressor unit 102. When the heat transfer unit 100 is in the mini-split configuration, as shown in FIG. 1, the first opening 114 may be closed. For example, a movable panel may be placed in the first opening 114 when the heat transfer unit 100 is in the mini-split configuration. In an embodiment, the movable panel may be attached to the housing of the compressor unit 102 via hinges or other attachment mechanisms that allow movement of one or more sides of the movable panel. The movable panel may be attached such that it allows the panel to move inwardly into the air duct 112 and/or outwardly away from the air duct 112. The second opening 116 may be located near a bottom of the housing of the compressor unit 102. In an embodiment, the second opening 116 may align in a same orientation with the first opening 114. In an alternative embodiment, the first and second openings 114, 116 may be out of alignment so as to be not oriented in the same orientation, as shown in FIG. 1. The air duct 112 may include a first section 112(1) and a second section 112(2). The first section 112(1) may include a substantially straight section having an opening near a top of the housing. The second section 112(2) may include a curved section or a section perpendicular to the first section. In an embodiment, a first side of the second section 112(2) may connect to the first section 112(1) and a second side of the second section 112(2) may open to the environment surrounding the compressor unit 102 via the second opening 116.

In an embodiment, the compressor unit 102 may operate in conjunction with a secondary unit. For example, the secondary unit may include at least one of the following: an evaporator unit, a cold plate, or a complementary compressor unit. In another embodiment, the compressor unit 102 may operate in conjunction with any number of secondary units.

As mentioned previously, FIG. 1 depicts the compressor unit 102 operating in conjunction with the evaporator unit 104. The evaporator unit 104 may include an expansion valve that reduces the pressure of the refrigerant in the heat transfer unit 100 and results in a rapid cooling of the refrigerant. The expansion valve may be controlled thermally, hydrostatically, or by a logic controller. The evaporator unit 104 may also include an evaporator coil 118 through which the refrigerant may flow. When the refrigerant flows through the evaporator coil 118, one or more fans 120 of the evaporator unit 104 may assist in circulating air over the evaporator coil 118 and into a room or environment that is desired to be cooled.

The evaporator unit 104 may further include a first opening 122 and a second opening 124. The first opening 122 may be located on a side of a housing of the evaporator unit 104 and may allow air to flow into the evaporator unit 104. The one or more fans 120 may assist this process by pulling air from the room or environment into the evaporator unit 104 and over the evaporator coil 118. The second opening 124 may allow air to pass back out of the evaporator unit 104. In an embodiment, the evaporator unit 104 may pull warm air into the evaporator unit 104 via the first opening 122, then push cold air out of the evaporator unit 104 via the second opening 124. The evaporator unit 104 may further include a third opening 126. The third opening 126 may be located on a bottom side of the housing of the evaporator unit 104. The third opening 126 may be located such that the third opening 126 of the evaporator unit 104 aligns with the first opening 114 of the compressor unit 102 when the evaporator unit 104 is stacked vertically on top of the compressor unit 102. However, in the mini-split configuration, the third opening 126 may be closed by a panel and/or by being placed on a surface (i.e., floor, ground, etc.).

Although FIG. 1 depicts the compressor unit 102 operating in conjunction with a single evaporator unit 104, it is contemplated that the compressor unit 102 may be communicatively coupled to any number secondary units of similar or different kinds. For example, in an embodiment, a compressor unit(s) may be implemented in conjunction with two or more evaporator units or vis versa. In another embodiment, a compressor unit(s) may be used in conjunction with one or more cold plates. A cold plate may be placed in a freezer, or other environment to be cooled. In still further examples, a compressor unit(s) may be communicatively coupled to an evaporator unit and a cold plate and would allow a user to selectively switch between the evaporator unit and the cold plate or allow a user to operate both at a same time.

The heat transfer unit 100 may further include one or more control units to control the operation of the heat transfer unit 100. In an embodiment, the one or more control units may allow a user to control the heat transfer unit 100 from a remote location. In such an embodiment, the one or more control units may communicate with a computing device of a user that allows the user to control the operation of the heat transfer unit 100.

Figure 2:
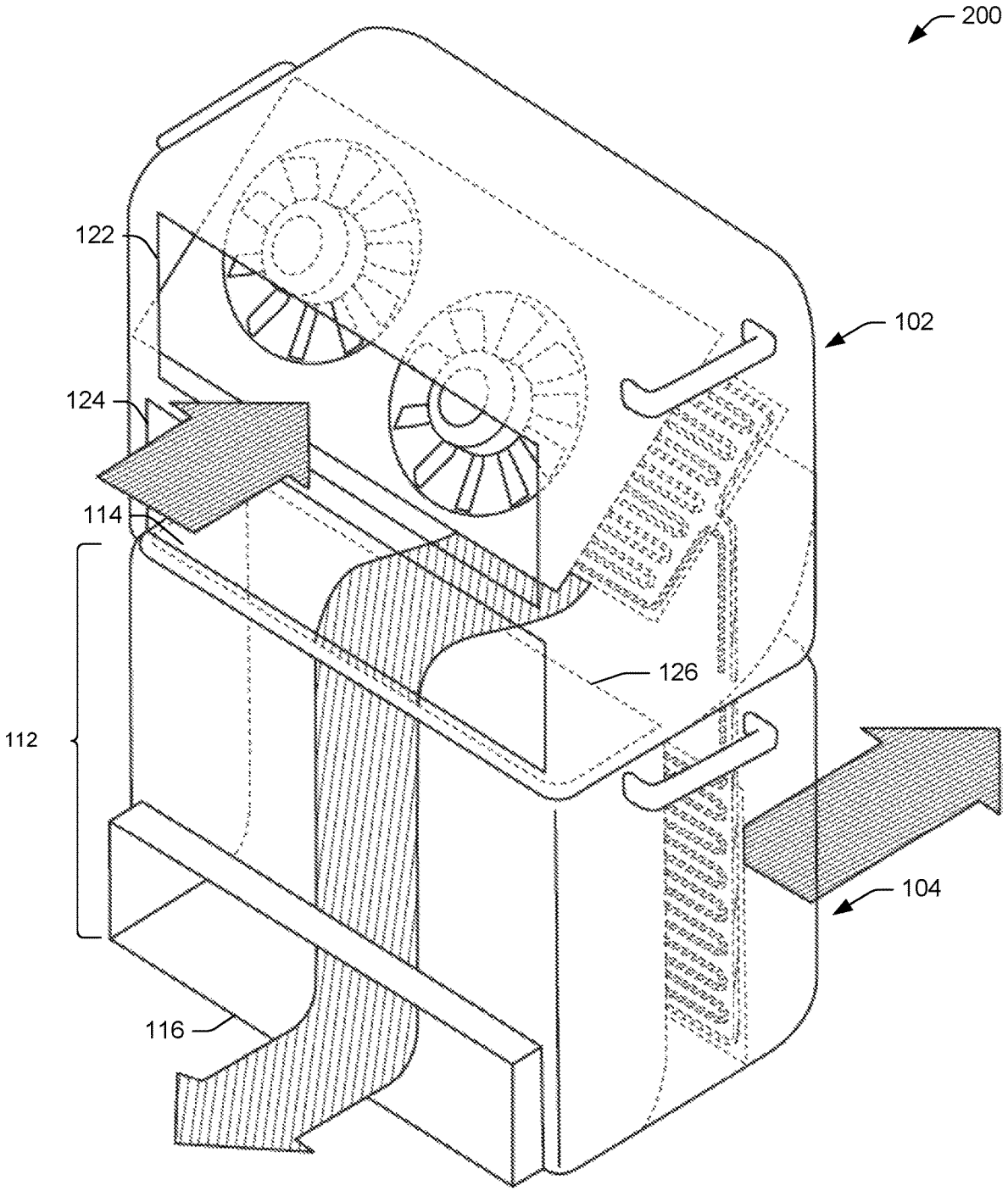
FIG. 2 illustrates a perspective view of the modular heat transfer unit of FIG. 1 in a second mode of operation.

FIG. 2 depicts the heat transfer unit 200, including its internal components, in a second mode of operation. In the second mode of operation, the evaporator unit 104 may be stacked vertically on top of the compressor unit 102. In such a mode of operation, the third opening 126 of the evaporator unit 104 may align with the first opening 114 of the compressor unit 102. In such an embodiment, the movable panel described above may be positioned such that air cannot flow through the second opening 124 of the evaporator unit 104, thus forcing air to travel through the third opening 126 into the air duct 112 of the compressor unit 102. The air then flows out of the second opening 116 of the compressor unit 102 into the environment surrounding the heat transfer unit 200. This configuration allows a user to implement the same heat transfer unit 100 in a first mode of operation (i.e., mini-split) and a second mode of operation (i.e., stacked). When the heat transfer unit 200 is operating in the stacked configuration, the heat transfer unit 200 may be mounted internally or externally. For example, if a shipping container is to be air-conditioned, the heat transfer unit 200 may be mounted to the outside of the shipping container or the heat transfer unit 200 may be mounted to the inside of the shipping container. The heat transfer unit 200 described herein allows for the flexibility of choosing where a user may desire to mount the heat transfer unit 200. In an embodiment, the evaporator unit 104 and the compressor unit 102 may be housed in a single housing when the heat transfer unit 200 is operating in a second mode of operation.

Figure 3:
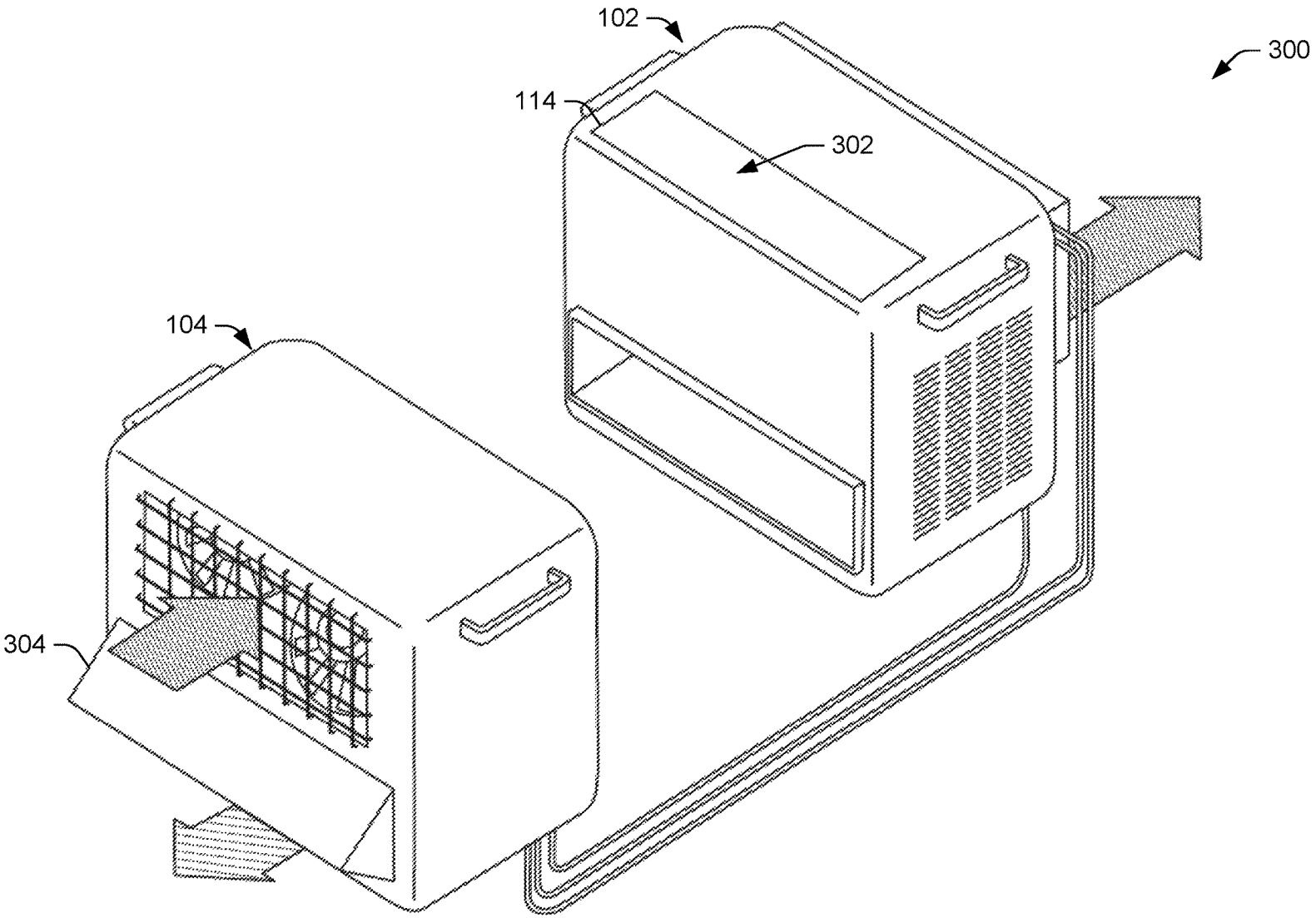
FIG. 3 illustrates a perspective view of an exterior of a modular heat transfer unit in the first mode of operation.

FIG. 3 depicts the exterior of the heat transfer unit 300 in the first mode of operation. FIG. 3 depicts a first movable panel 302 on the compressor unit 102 closing the first opening 114 of the compressor unit 102. In an embodiment, the first movable panel 302 of the compressor unit 102 may be omitted. FIG. 3 further depicts a second movable panel 304 that is actuatable to open and close the second opening 124 of the evaporator unit 104. In a first mode of operation, the second movable panel 304 may be positioned in an open position to allow air flow out of the second opening 124.

Figure 4:
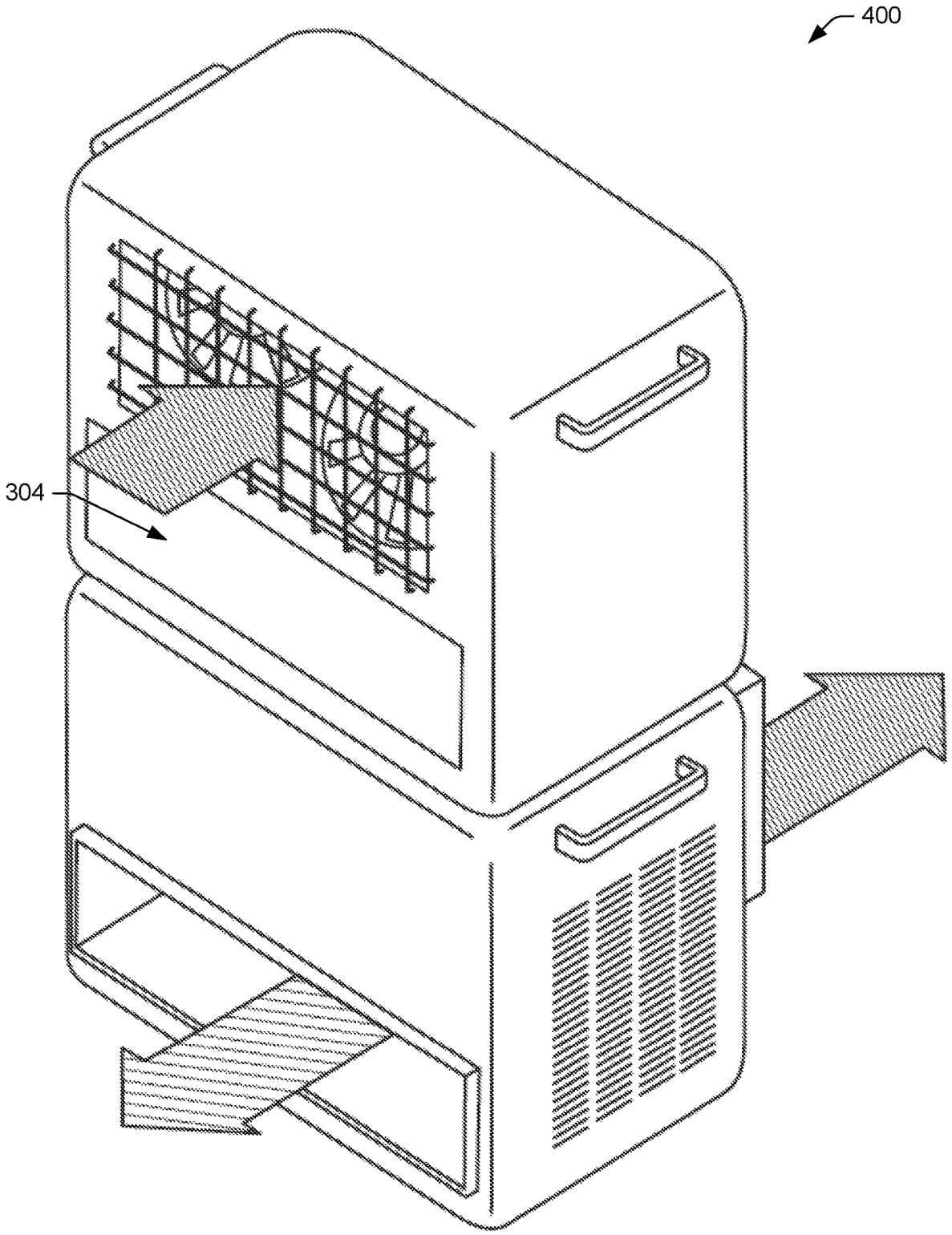
FIG. 4 illustrates a perspective view of the exterior of the modular heat transfer unit of FIG. 3 in the second mode of operation.

FIG. 4 depicts the exterior of the heat transfer unit 400 in the second mode of operation. As mentioned previously, the first movable panel 302 (not seen) may be open to allow air inflow from the evaporator unit 104. As shown in FIG. 4, the second movable panel 304 may be closed to force air flow into the air duct 112 of the compressor unit 102.

Figure 5:
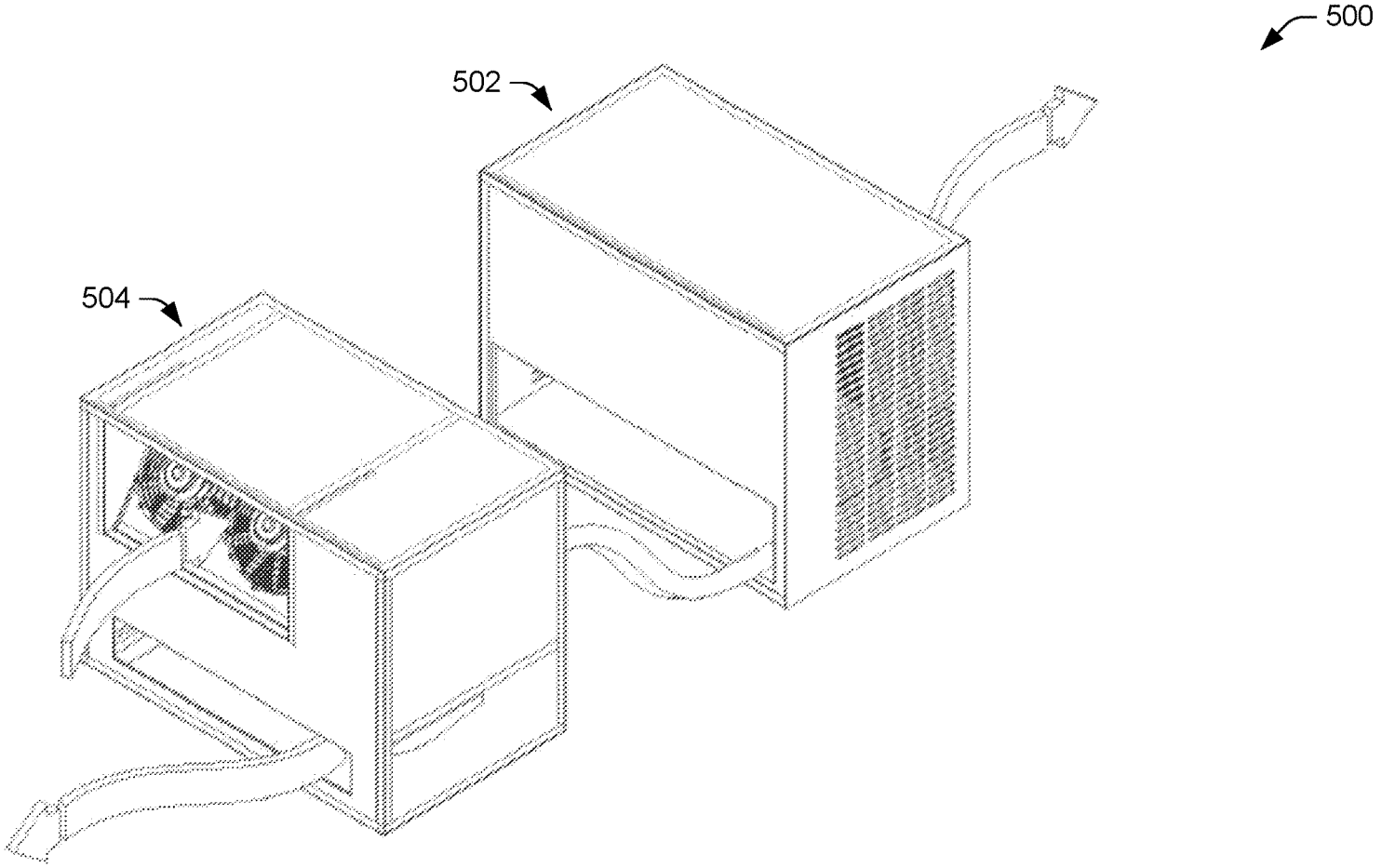
FIG. 5 illustrates a perspective view of an exterior of an alternative embodiment of a modular heat transfer unit in a first mode of operation.

FIG. 5 depicts a perspective view of an exterior of a second embodiment of an heat transfer unit 500 described above in a first mode of operation. The first mode of operation may be a mini-split configuration. FIG. 5 depicts another embodiment of the heat transfer unit 500 having a different housing than the heat transfer unit depicted in FIGS. 1-4. The embodiment of the heat transfer unit 500 may include substantially the same internal components as the first embodiment. For example, the second embodiment of the heat transfer unit 500 may include a compressor and condenser in a compressor unit 502 and an evaporator and expansion valve in an evaporator unit 504. The heat transfer unit 500 in FIG. 5 may also include similar ducting an openings as the heat transfer unit in FIGS. 1-4.

Figure 6:
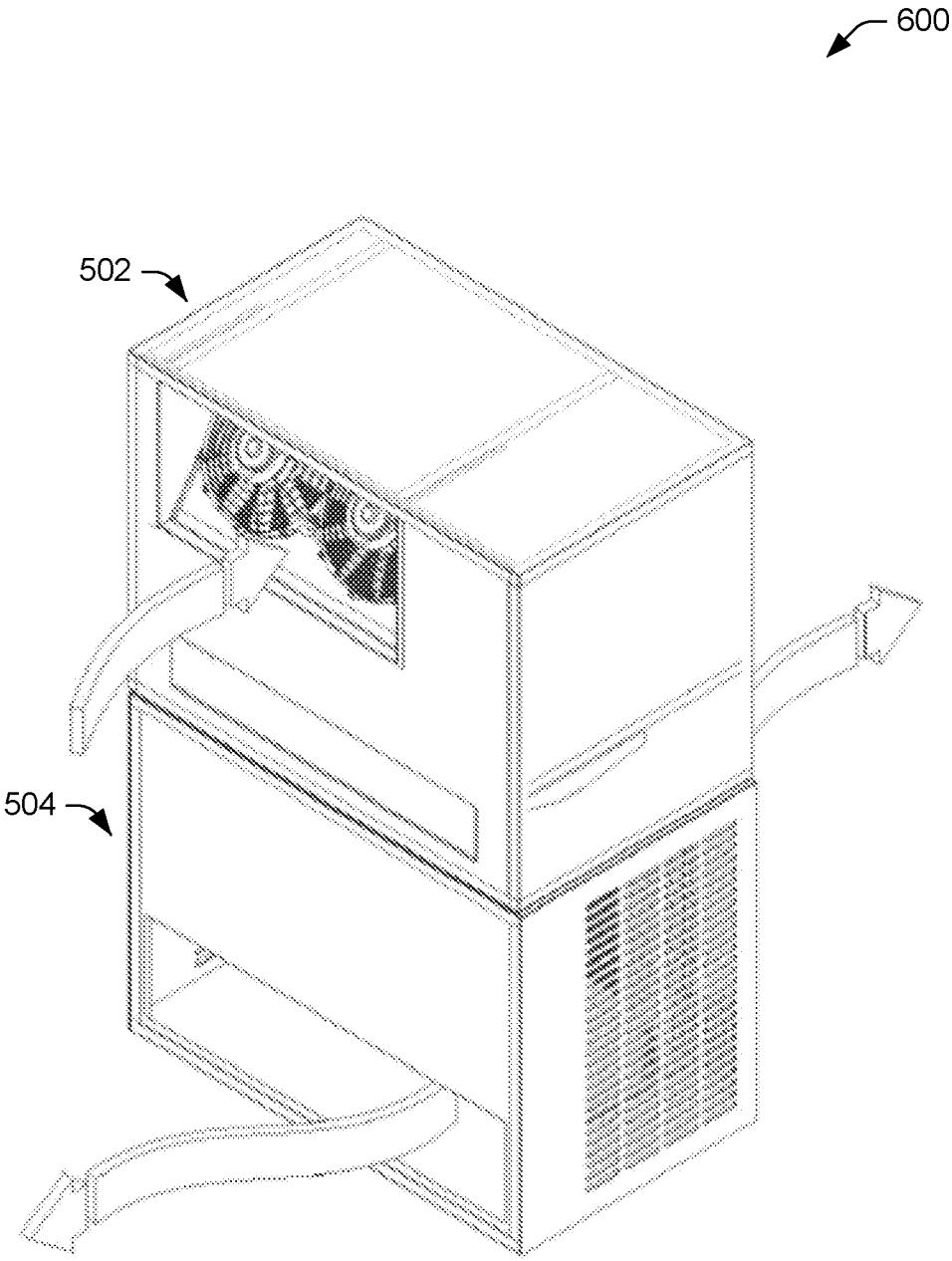
FIG. 6 illustrates a perspective view of the exterior of the embodiment of the modular heat transfer unit of FIG. 5 in a second mode of operation.

FIG. 6 depicts a perspective view of the second embodiment of the heat transfer unit 600 of FIG. 5 in a second mode of operation. The second mode of operation may be a vertically stacked configuration. As mentioned previously, the heat transfer unit 600 in FIGS. 5-6 may have the same or substantially similar functionality of the heat transfer unit 100 in FIGS. 1-4.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the claimed subject matter.

What is claimed is:

1. A heat transfer system comprising:

a first housing including:

a compressor configured to increase a pressure of refrigerant flowing in the heat transfer system, a condenser, in fluid communication with the compressor, configured to decrease a temperature of the refrigerant, and one or more fans disposed adjacent to the condenser, the one or more fans configured to decrease the temperature of the refrigerant; and an air duct disposed on a side of the housing, the air duct including:

a first section disposed adjacent the housing, and a second section connected to the first section and disposed near a bottom of the housing; and a second housing in fluid communication with the first housing, the second housing being an evaporator unit including:

a first opening in a side of the second housing to allow air flow into the second housing, a second opening in the side of the second housing to allow air flow out of the second housing, and a third opening to allow air flow into the air duct of the first housing when the first housing and the second housing are stacked vertically.

2. The heat transfer system according to claim 1, wherein the first section includes a substantially straight section having an opening near a top of the housing.

3. The heat transfer system according to claim 1, wherein the second section includes a curved section, and wherein a first side of the curved section connects to the first section and a second side of the curved section opens to an environment surrounding the heat transfer system.

4. The heat transfer system according to claim 1, wherein the heat transfer system is a compressor unit in a split heat transfer system.

5. The heat transfer system according to claim 1, wherein the first housing includes a compressor unit and the compressor unit is configured to operate in conjunction with the evaporator unit and a tertiary unit.

6. The heat transfer system according to claim 5, wherein the tertiary unit includes at least one of an additional evaporator unit, a cold plate, or a complementary compressor unit.

7. The heat transfer system according to claim 1, wherein the third opening is located on a bottom side of the second housing.

8. The heat transfer system according to claim 1, wherein the second housing further includes:

an expansion valve to decrease a temperature and pressure of the refrigerant, and an evaporator configured to increase a temperature of the refrigerant.

9. A heat transfer system comprising:

a first housing including:

a compressor configured to increase a pressure of refrigerant flowing in the heat transfer system, and a condenser, in fluid communication with the compressor, the condenser being configured to decrease a temperature of the refrigerant;

an air duct disposed on a side of the first housing, the air duct including:

a first section disposed adjacent the first housing, and a second section connected to the first section and disposed near a bottom of the first housing; and a second housing in fluid and electrical communication with the first housing, the second housing including:

an expansion valve to decrease a temperature and pressure of the refrigerant, an evaporator configured to increase a temperature of the refrigerant, a first opening in a side of the second housing to allow air flow into the second housing, a second opening in the side of the second housing to allow air flow out of the second housing, and a third opening to allow air flow into the air duct of the first housing when the first housing and the second housing are stacked vertically.

10. The heat transfer system according to claim 9, wherein the heat transfer system is configured to operate in a first state in which the first housing and the second housing function in a split configuration and a second state in which the second housing is stacked vertically on top of the first housing to function as an adjoined unit.

11. The heat transfer system according to claim 10, wherein the second opening is closed when the first housing and the second housing are stacked vertically.

12. The heat transfer system according to claim 9, wherein the first housing is further in fluid and electrical communication with a cold plate.

13. The heat transfer system according to claim 9, wherein the third opening is disposed on a bottom surface of the second housing.

14. The heat transfer system according to claim 9, the heat transfer system further comprising conduit configured to flow the refrigerant between the first housing and the second housing.

15. A heat transfer unit comprising:

a compressor unit including an air duct disposed on a side of the compressor unit, the air duct including:

a first section disposed on the side of the compressor unit, and a second section connected to the first section and disposed near a bottom of the side of the compressor unit; and an evaporator unit including:

a first opening in a side of the evaporator unit to allow air flow into the evaporator unit, a second opening located below the first opening in the side of the evaporator unit to allow air flow out of the evaporator unit, a movable panel configured to close the second opening when the evaporator unit is stacked on the compressor unit, and a third opening disposed on a bottom of the evaporator unit to allow air to flow into the air duct when the evaporator unit is stacked on the compressor unit.

16. The heat transfer unit according to claim 15, wherein the second section of the air duct includes an opening located near a bottom of the compressor unit.

17. The heat transfer unit according to claim 16, wherein the first opening in the evaporator unit and the opening in the second section of the air duct are spaced at a distance (D) when the evaporator unit is stacked on the compressor unit.

18. The heat transfer unit according to claim 16, wherein the heat transfer unit is configured to be interior mounted or exterior mounted when the evaporator unit is stacked vertically with the compressor unit.

19. The heat transfer unit according to claim 16, wherein the heat transfer unit further comprises conduit configured to flow refrigeration fluid between the compressor unit and the evaporator unit, the conduit including positive lock connections disposed at either end of the conduit.

20. The heat transfer unit according to claim 15, further comprising a cold plate communicatively coupled to the compressor unit, wherein the cold plate is selectively operable instead of or in addition to the evaporator unit.

* * * * *